United States Patent [19]

Becker et al.

[11] Patent Number: 4,518,284

[45] Date of Patent: May 21, 1985

[54] MINE ROOF SUPPORTS

[75] Inventors: Kunibert Becker, Werl; Rüdiger Kirchbrücher, Dortmund-Brackel; Klaus D. Pohlmann, Werne, all of Fed. Rep. of Germany

[73] Assignee: Gewerkschaft Eisenhutte Westfalia, Fed. Rep. of Germany

[21] Appl. No.: 480,614

[22] Filed: Mar. 30, 1983

[30] Foreign Application Priority Data

Mar. 30, 1982 [DE] Fed. Rep. of Germany ..... 3211595

[51] Int. Cl.[3] ..... E21D 23/04

[52] U.S. Cl. ..... 405/296; 405/299

[58] Field of Search ..... 405/288, 291, 296, 299, 405/300; 299/33

[56] References Cited

U.S. PATENT DOCUMENTS 3,474,627 10/1969 Groetschel ..... 405/296
3,943,723 3/1976 Evans et al. ..... 405/296
4,352,602 10/1982 Plaga ..... 405/291

FOREIGN PATENT DOCUMENTS 1945980 7/1973 Fed. Rep. of Germany ..... 405/296
2212994 9/1973 Fed. Rep. of Germany ..... 405/296

*Primary Examiner*—David H. Corbin
*Attorney, Agent, or Firm*—Sughrue, Mion, Zinn, Macpeak & Seas

[57] ABSTRACT

A mine roof support has a goaf shield with a lemniscate guide system linking the shield to floor-engaging skids. A walking-mechanism is disposed in a channel between the floor skids. In order to prevent rubble or goaf material from penetrating into the channel the guides of the lemniscate system have connections which are spaced one above the other and to which one or several screen plates can be removably and replaceably attached with the aid of push-in locking-bars. The screen plates also advantageously serve to keep the floor skids apart by a minimum distance to prevent jamming of the walking mechanism.

12 Claims, 11 Drawing Figures

MINE ROOF SUPPORTS

BACKGROUND TO THE INVENTION

The present invention relates to mine roof supports and particularly to supports which employ a goaf shield with a lemniscate guide system linking the goaf shield to the floor-engaging structure of the support.

In such supports, it is known to use a divided floor-engaging structure with a pair of spaced-apart skids which are able, independently of each other, to adjust themselves to uneven areas of the floor. A walking mechanism employing a hydraulic ram can be arranged in the gap between the floor skids. The walking mechanism usually comprises two resilient guide rods or bars with the shifting ram therebetween. The guide rods are connected at their ends nearest the mineral face with a head-piece attached to a longwall conveyor or to some other travelling backing means. At the opposite goaf-side ends, the guide rods are connected to a guide element which moves along guides associated with the floor skids. German patent specification No. 25 40 091 describes a support of this known type. In this known construction, it is necessary to protect the walking mechanism between the floor skids; otherwise material from the rubble or goaf zone can penetrate the gap between the skids and disable the mechanism. For this purpose, a box can be connected to the goaf shield, as described in German patent specification No. 24 51 757. It is also known, in another aspect, i.e. for the purpose of protecting the main longwall working from the rubber or goaf zone, to provide a goaf screen which is composed of swivelling-suspended screen plates or the like, which overlap each other in the manner of fish-scales—see German patent specification No. 22 12 994.

In the case of the known lemniscate guided goaf shields with a walking mechanism arranged between the floor skids, the walking mechanism can become jammed between the floor skids despite the prevention of material from passing into the gap. During the outward thrust of the shifting ram, a moment is applied to the floor skids which tends to move the goaf-side ends of the skids towards each other and, in some circumstances, this leads to jamming or even blocking of the walking mechanism between the floor skids. Uneven areas of the floor aggravate the tendency of the floor skids to move towards each other at their goaf-side ends.

A general object of the present invention is to provide an improved roof support.

SUMMARY OF THE INVENTION

In accordance with the invention, a roof support comprises a floor-engaging structure, a roof-engaging structure, hydraulic props mounted between the floor and roof-engaging structures and a goaf shield connected to the floor-engaging structure with lemniscate guides spaced apart laterally from the support; wherein the guides are provided with connection means for releasably attaching at least one screen plate to screen off the lower region of the goaf zone from the interior of the support.

A roof support constructed in accordance with the invention can be distinguished by the simple and robust construction of the screening means and by the case with which it can be assembled and dismantled. It is also possible in some circumstances to dismantle the goaf shield and to rely on the screening means fitted to the lemniscate guides.

The floor-engaging structure preferably takes the form of a pair of laterally-spaced skids with a walking mechanism therebetween. In this case, the screen plate or plates prevent the skids from moving too close together and jamming Furthermore, this will prevent blocking of the walking mechanism without impeding the independent adjustment movements of the floor skids.

In accordance with the invention two parallel guides or levers i.e., preferably the lower goaf-side guides of the lemniscate guide system have special superimposed connections for releasably connecting, in a rapid manner one or more screen plates, which screen the space, lying below the goaf shield and between the guides, from the rubber or goaf zone, so that no material can pass from the goaf zone into the longwall chamber and the roof-support chamber. In the case of a support with a divided floor-engaging structure with a walking mechanism arranged in a gap or channel between the floor skids, the gap for the mechanism is reliably sealed off on the goaf side by the screen plate or plates connected to the guides.

The connection between the screen plates on the one hand and the guides on the other can be swivellable and so designed that the screen plates are reliably braced on the roof-support against the pressure from the rubble or goaf zone, whereas, in the opposite direction, they can thus be swung toward the goaf zone so that any fine material, e.g. coal dust and the like, that penetrates into the walking mechanism channel, can pass rearwardly out of the channel during the walking or shifting of the support.

In a preferred embodiment of the invention the connections on the guides consist of locking openings, into which can be introduced a simple push-in locking-bar which carries the screen plate. The locking openings are preferably in the form of slots arranged with their axes inclined at a sharp angle relatively to the longitudinal axis of the associated guide. The freedom of movement of the floor skids and of the guides of the support and in particular the ability of the support to adapt to uneven areas of the floor are not adversely affected by the interposed screen plate or plates. When a simple push-in locking bar is used for connecting the screen plates, the arrangement is advantageously such that each screen plate is in turn readily releasable and can be freely moved in the axial direction of the push-in locking-bar and connected thereto, so that it is able to follow the adjustment movement of the floor skids and therefore those of the push-in locking-bar. For this purpose, the locking bar is advantageously provided with a guide slot in which the shield plate can be suspended, preferably by means of a connecting hook or the like.

With the aid of the above-mentioned locking-bar connection, the screen plate can be introduced from the shield chamber and, if necessary, can also be removed again, and, if required, replaced by shield plates of other lengths. In this arrangement, the push-in locking-bar advantageously has a hook-like bolt at each of its two ends, which bolt head can be readily introduced into the appropriate locking opening of the guide from the shield chamber side. The locking openings of the guides and the hook-like bolt heads of the push-in locking-bar are so shaped that a certain longitudinal and articulation clearance of the push-in locking-bar is provided in the openings. This enables the relative adjustment movement of the floor skids to take place so as to cope with uneven areas of the floor. For the purpose of facilitating the assembly and dismantling of the screen plates, the push-in locking-bar is advantageously so designed that its guide slot is offset in the axial direction from the middle of the bar in such manner that the distance between one of the bolt heads to the guide slot is greater than the distance between the other bolt head from the guide slot. Furthermore, the push-in locking-bar of the invention advantageously consists of a locking bolt which, between its two hook-like heads has a widened portion which is offset from the middle of the bolt towards one of the ends of the bolt and in which the guide slot is formed.

Generally, it is preferred to fit a plurality of overlapping screen plates between the goaf-side guides with at least the bottom screen plate braced against stops in the lower zone and at the side facing the longwall chamber, whereas the overlapping screen plates can be supported against each next adjacent lowest plate.

The invention may be understood more readily, and various aspects and features of the invention may become more apparent, from consideration of the following description.

BRIEF DESCRIPTION OF DRAWINGS

An embodiment of the invention will now be described, by way of example only, with reference to the accompanying drawings, wherein.

DESCRIPTION OF PREFERRED EMBODIMENT

Figure 1:
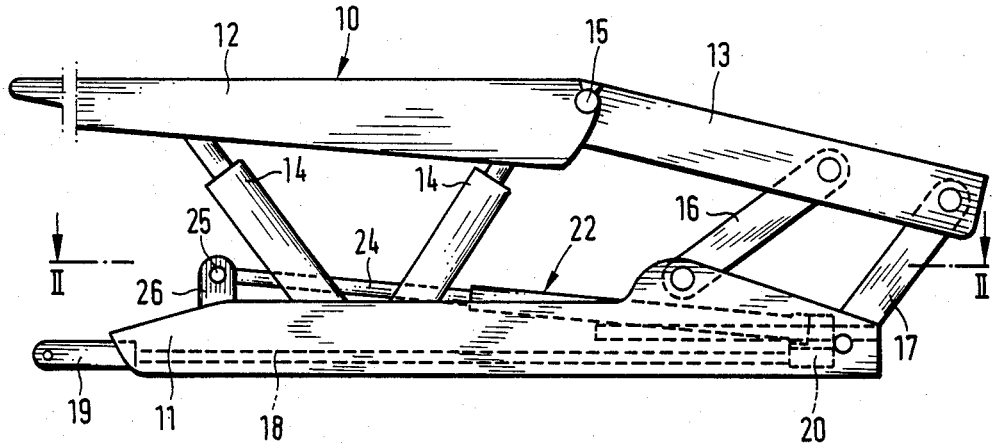
FIG. 1 is a diamgrammatic side view of a roof support constructed in accordance with the invention.
Figure 2:
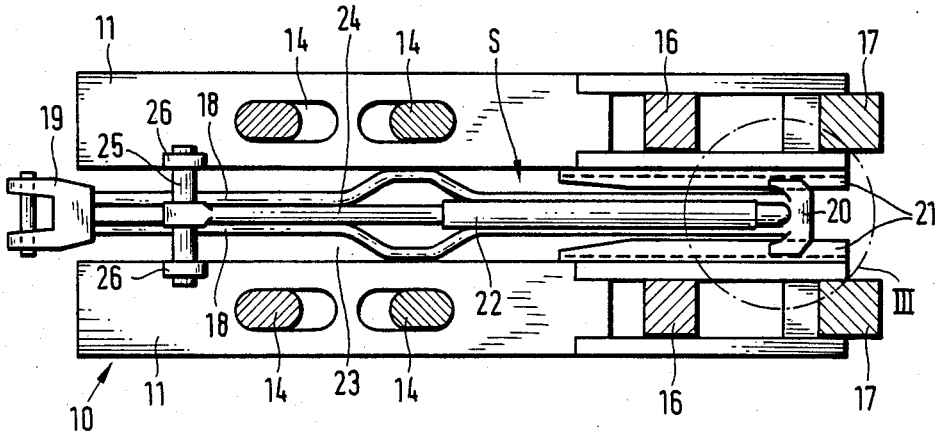
FIG. 2 is a sectional plan view taken along the line II—II of FIG. 1.

The roof support 10, illustrated diagrammatically in FIGS. 1 and 2 employs a lemniscate-guided goaf shield 13 and has a divided floor-engaging structure or sill in the form of laterally spaced skids 11. A one-piece roof-engaging structure or cap 12 is carried by four hydraulic props 14. The props 14 are arranged in pairs and are connected via pivots, conveniently universal joints, to the floor skids 11 and to the cap 12. The goaf shield 13 is likewise a one-piece component connected by way of a pivot joint 15, to the goaf-side end of the cap 12. The goaf shield 13 is connected to the floor skids 11 with the aid of a lemniscate guide system composed of guides or leavers 16, 17. These levers 16, 17 are pivoted to the floor skids 11, and, at their upper ends, to the goaf shield 13. Each floor skid 11 is connected by a separate guide lever 16, 17 to the goaf shield 13.

The space between the two parallel floor skids 11 forms a channel 23 which accommodate a walking mechanism S. As illustrated, the walking mechanism S employs a pair of elongate shaped guide rods 18, which may be resilient round bars which are interconnected at their ends nearest the mineral face by a headpiece 19 usually pivoted on a shiftable conveyor (not shown). The rear, i.e. goaf-side, ends of the guide rods 18 are connected by way of a guide element 20 which takes the form of a crossbeam or yoke displaceable along guides 21, which are arranged on mutually-facing lateral surfaces of the floor skids 11. The guides 21 may take the form of rails which engage in grooves formed in the guide element 20. Alternatively, the guides 21 may be formed by grooves in which the guide element 20 engages. The walking mechanism S also has an in-line double-acting hydraulic walking ram 22, which is pivoted with its cylinder to the guide element 20 by means of a bifurcated connecting element or bracket (not illustrated). The piston rod 24 of the ram 22 is connected to a cross-beam or a hinge-pin 25 which is mounted in brackets 26 associated with the floor skids 11.

The goaf shield 13 prevents the flow of rubble or goaf material into the shield chamber and therefore the longwall zone. Below the shield 13, the walking mechanism channel 23 between the floor skids 11 is open towards the rubber or goaf zone (FIGS. 3A and 3B), so that rubble or goaf material can penetrate into the walking mechanism channel 23. This is particularly the case when the roof support is used in an inclined site.

The floor skids 11 of the support are not only vertically displaceable relative to each other, but their lateral spacing can also be varied to some extent. FIG. 2, in particular, shows that the guide element 20 can become clamped between the guides 21 if the floor skids 11 move too close together at their goaf-side ends. This can lead to troublesome blockage of the walking mechanism S.

Figure 3A:
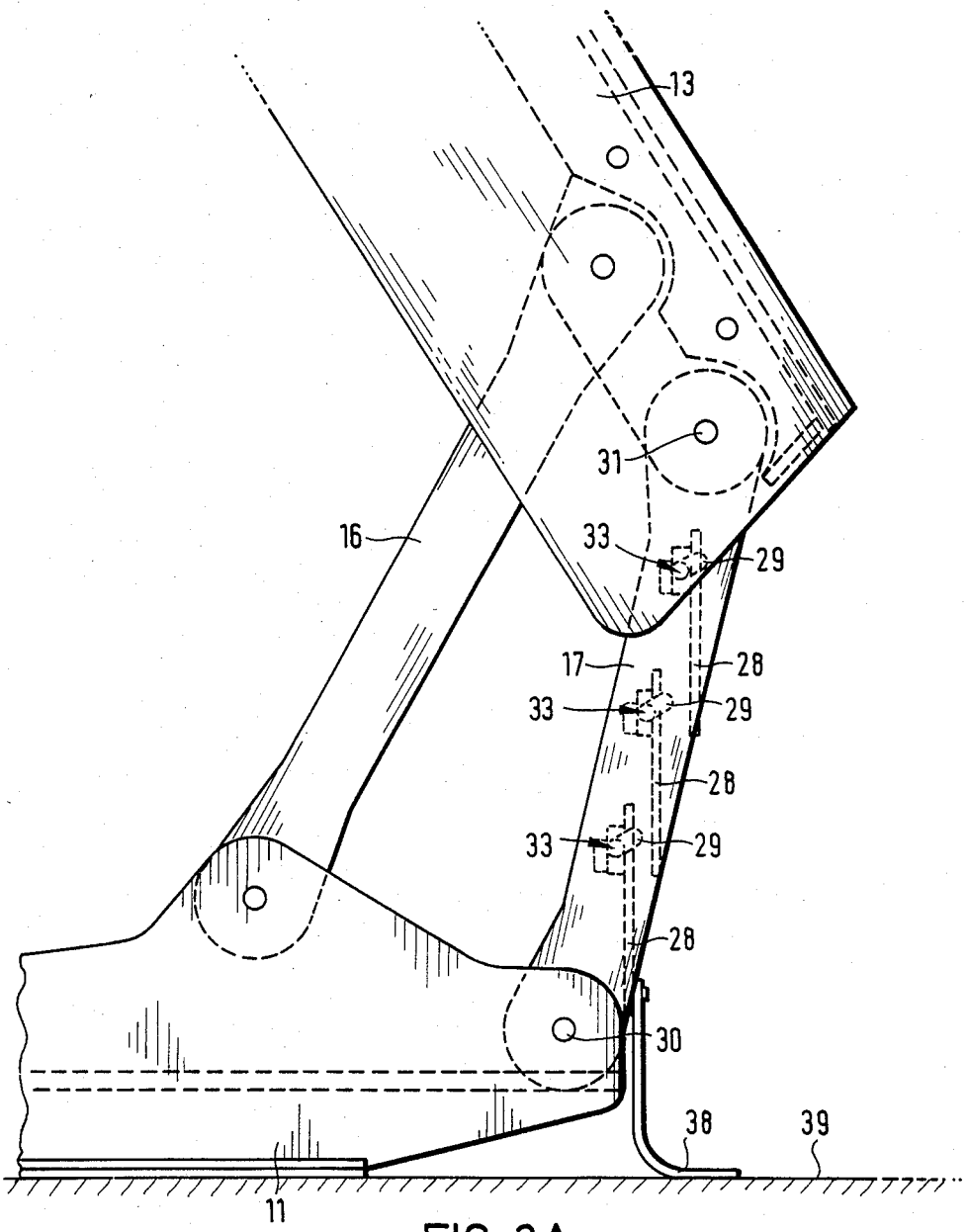
FIGS. 3A and 3B are side views of part of the roof support depicting its screening means in different operating positions, the views being taken on a somewhat larger scale to FIGS. 1 and 2.
Figure 3B:
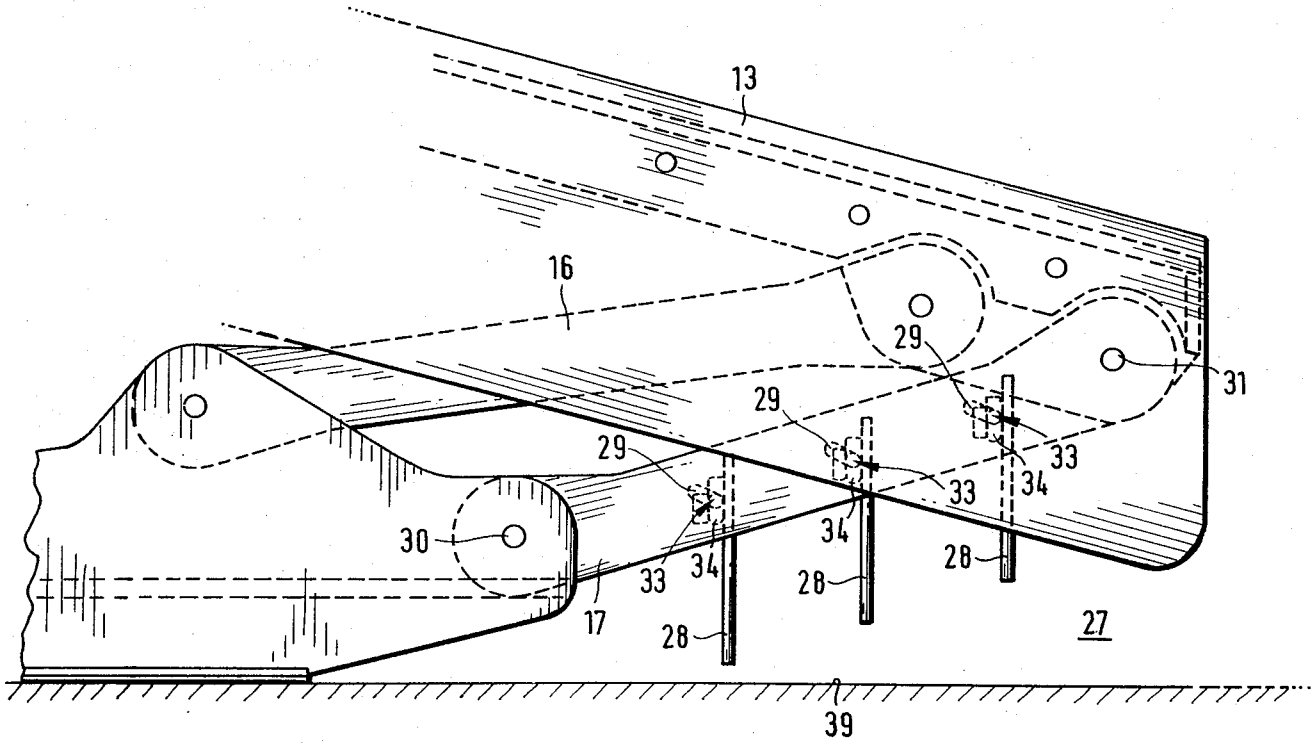

As shown in FIGS. 3A, 3B, 4A and 4B screening means is provided to screen off the shield chamber from the rubble or goaf-zone below the shield 13. This means is composed of a plurality of screen plates 28 attached to the lower goaf-side guides 17. The screen plates 28 overlap one another so that the gap between the floor skids 11, on the one hand, and the underside of the goaf shield 13 on the other, is virtually sealed off over its entire height. As shown in FIG. 3A, a rubber curtain 38 may also be attached to the lower screen plate 28 to engage on the floor 39. The parallel goaf-side guides 17 are provided with spaced superposed connections 29 which, between the pivot joints 30 and 31 of the guides 17 and in the axial direction of the guides, are disposed one above the other and are formed by locking openings in the form of slots. The axes of the slots are disposed at a narrow angle relative to the longitudinal axes of the guides 17, as shown in FIGS. 3A and 3B.

Figure 5:
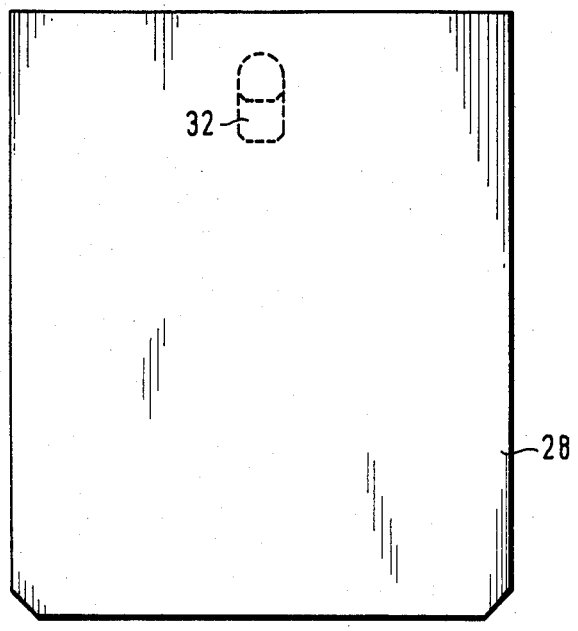
FIG. 5 depicts one of the screen plates of the support.
Figure 6:
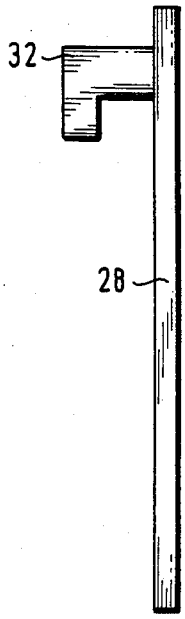
FIG. 6 is a side view of the screen plate of FIG. 5.
Figure 7:
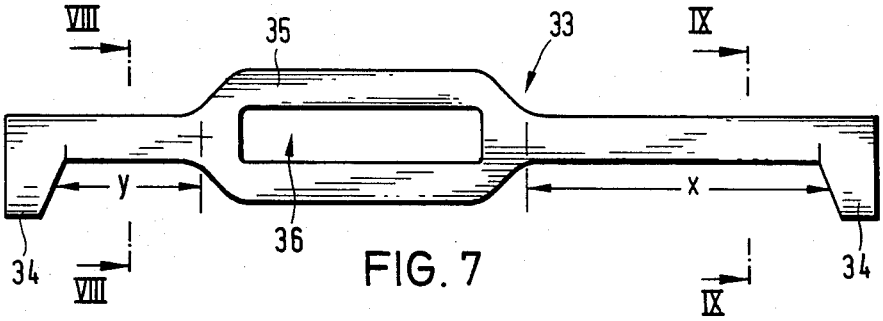
FIG. 7 depicts the locking-bar of the support.
Figure 8:
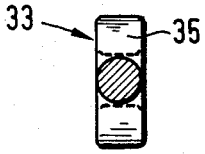
FIG. 8 is a section taken along the line VIII—VIII of FIG. 7.
Figure 9:
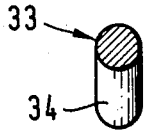
FIG. 9 is a section taken along the line IX—IX of FIG. 7.

As shown in particular in FIGS. 5 and 6, the screen plates 28 each consist of a strong, substantially rectangular metal sheet which has a connecting hook 32 on its rear face and in the upper zone and along the vertical centre axis. For purpose of connecting the screen plates 28 to the guides 17, use is made of push-in locking-bars 33. These bars 33 have hook-like heads 34 at each of their ends. Between the two hook-like heads 34, the locking-bar 33 has a widened intermediate portion 35 which is offset from the middle of the bolt and has a guide slot 36 which extends in the axial direction of the bar. An associated screen plate 28 is suspended by its hook 32 engaged in the guide slot 36. The screen plate 28 is thus displaceable, to the extent of the clearance of the connecting hook 32, in the guide slot 36 and relative to, and in the axial direction of, the locking-bar 33.

Figure 4A:
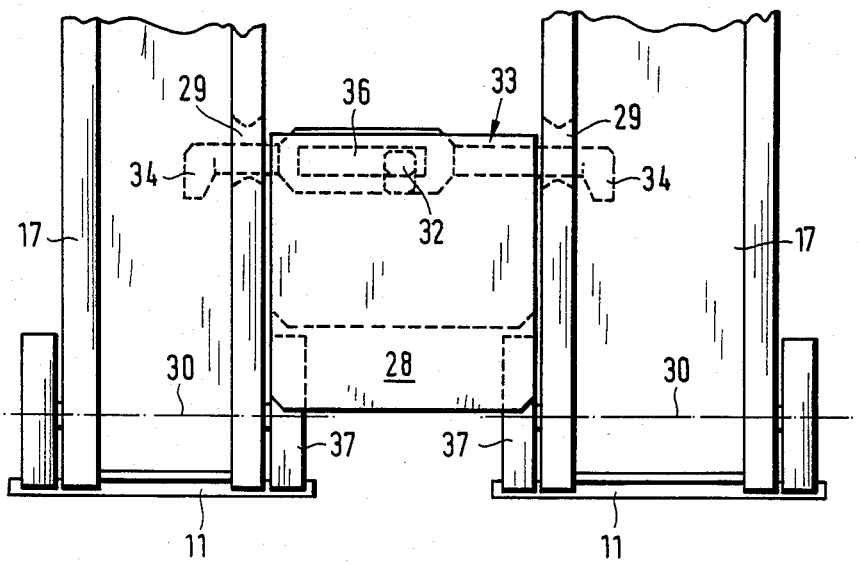
FIGS. 4A and 4B are rear views of part of the roof support depicting one of the locking bars in different operating positions, the views being taken on a somewhat larger scale to FIGS. 1 and 2.
Figure 4B:
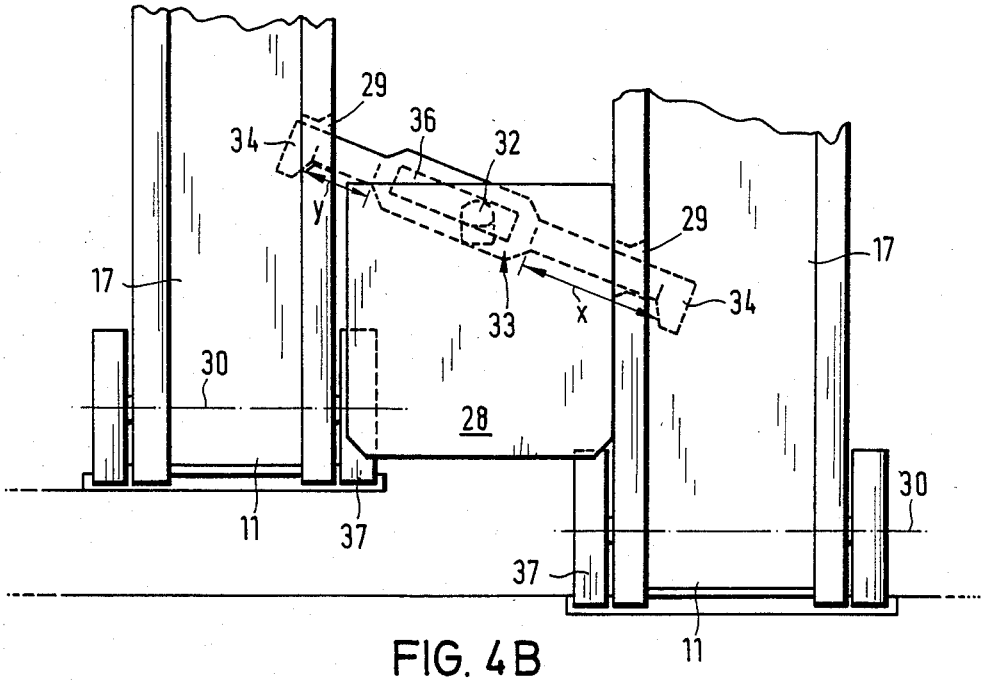

As shown in FIGS. 4A and 4B, the locking openings or slots 29, are so formed that they taper or flare outwards at both sides. The screen plates 28 can be connected to the guides 17 from the shield cavity side and without the use of special tools. For this purpose, they are suspended by their connecting hooks 32 in the guide slot 36 of the locking bars 33. Each locking-bar 33 together with the connected screen plate 28 is then inserted into the appropriate openings 29 from the shield cavity side. The introduction of the locking-bars 33 into the openings 29 is facilitated by the asymmetric arrangement of the guide slot 36. The latter is offset from the middle of the length of the push-in locking-bar so that the distance X from one of the heads 34 to the slot 36 is greater than the distance Y from the other head 34 to the slot 36. It is therefore possible to introduce the locking-bar 33, provided with the suspended screen plate 28, into the corresponding locking opening 29 of one guide 17 and with the bolt head 34 initially at the distance X, and to push the locking-bar 33 so far through the locking opening that the other bolt head 34 lies in front of the locking opening 29 of the other guide 17 and can be pushed through the locking opening of this guide by displacement of the locking-bar 33 in the opposite direction. FIG. 4A shows a single screen plate 28 and its push-in locking bar 33 which is held, with a certain degree of axial and radial motional play in the locking openings 29 of the two parallel guides 17, the hooked ends of the heads 34 securing the push-in locking-bar 33. The floor skids 11 are at the same level, so that the axis of the locking bar 33 is approximately parallel to the floor. At its inner side facing the mineral face, the screen plate 28 is braced against stops 37 at the lower ends of the guides 17, i.e. in the zone of their joints 30, so that the swingably suspended screen plate 28 is able to take up the pressure from the rubble or goaf zone. If coal dust or the like collects in the walking-mechanism channel 23, it is able to escape from the channel 23 on the goaf side when the shield 13 is shifted. When this happens, the bottom screen plate 28 may be swung out slightly towards the rubble or goaf zone if so required.

FIG. 4B shows the situation when the floor skids 11 are at different levels. This relative movement matching uneven areas of the floor, is not inhibited by the connection of the screen plate 28 to the guides 17. On the contrary, as shown in FIG. 4B, the push-in locking bar 33 executes a swinging movement during these vertical movements and it swings into the inclined position shown in FIG. 4B. During this movement, the connecting hook 32 associated with the screen plate 28 moves along the guide slot 36 of the push-in locking-bar 33 with the result that the screen plate 28 maintains its position between the guides 17.

The width of the screen plates 28 is such that they bridge the two guides 17 and therefore the floor skids 11 by such distance that the floor skids 11 cannot move sufficiently close to each other at their goaf-side ends to cause jamming and blocking of the walking mechanism S. Thus, the screen plates 28 also act as means to space the floor skids 11 at their minimum distance without preventing the floor skids 11 from moving for adjustment purposes.

As shown in FIG. 3A, three screen plates 28 are each attached to the guides 17 by means of a push-in locking-bar 33 and in spaced relationship one above the other in such manner that they overlap. FIG. 3A shows the support when its props 14 are fully extended. If the props 14 are fully retracted, the screen plates 28 swing into the position shown in FIG. 3B. If the support is used in a manner in which the props 14 are retracted to a relatively small extent, it may suffice to provide a single screen plate 28 or two plates offset from each other in the vertical direction.

The locking-bar connection permits rapid installation and dismantling as well as replacement of the screen plates 28 by plates of other dimensions.

We claim:

1. A mine roof support comprising a floor-engaging structure, a roof-engaging structure, hydraulic props mounted between the floor and roof-engaging structures and a goaf shield connected to the floor-engaging structure with lemniscate guides spaced apart laterally of the support; wherein the floor engaging structure takes the form of spaced-apart skids with a walking mechanism therebetween, the skids being relatively displaceable, at least to a limited extent, in both a direction transverse thereto and vertically, and, the guides are provided with connection means for releasably attaching at least one screen plate to screen off the lower region of the goaf zone from the interior of the support, said at least one screen plate also forming a distance piece defining the minimum spacing between the skids.

2. A support according to claim 1, wherein the guides are each provided with a plurality of superposed connection means for receiving a plurality of said screen plates.

3. A support according to claim 1, wherein the connection means of the guides takes the form of locking openings into which can be introduced a push-in locking bar from which said at least one screen plate is suspended.

4. A support according to claim 3, wherein said at least one screen plate is releasable from the push-in locking bar and is arranged to be freely movable in the axial direction thereof.

5. A support according to claim 4, wherein the push-in locking bar is provided with a guide slot in which said at least one screen plate is suspended.

6. A support according to claim 5, wherein said at least one screen plate has a connecting hook which is engaged in the guide slot of the push-in locking-bar to suspend said screen plate.

7. A support according to claim 3, wherein the push-in locking-bar has, at its ends hook-like heads which can be readily pushed through the locking openings in the guides.

8. A support according to claim 3, wherein the locking openings in the guides take the form of slots which are inclined relatively to the axes of the guides.

9. A support according to claim 5, wherein the guide slot is offset from the middle of the push-in locking-bar in such a manner that the distance between one of the ends of the locking-bar and the guide slot is greater than the distance between the other end and the guide slot.

10. A support according to claim 5, wherein the locking bar has hook-like heads at its ends, and a widened intermediate portion which is offset from the centre of the bolt towards one of the ends of the bolt and in which the guide slot is formed.

11. A support according to claim 1, wherein a plurality of overlapping screen plates are fitted between the guides with at least the bottom screen plate being supported against stops.

12. In a mine roof support comprising a pair of laterally-spaced floor-engaging skids, which are independently relatively displaceable, at least to a limited extent, a roof-engageable structure, a plurality of hydraulic props disposed between the skids and the roof-engageable structure, a goaf shield pivotably connected to the roof-engageable structure and the skids with means including a lemniscate guide system with guide levers connected between the skids and the shield and a walking mechanism located between the skids; the improvement comprising screening means composed of overlapping releasable screen plates displaceably suspended from bars which detachably engage as push-in connections with laterally-spaced guide levers of the guide system, said screen plates serving additionally as means for defining the minimum spacing between the skids to prevent jamming.

* * * * *